United States Patent [19]

Koch

[11] 4,215,519

[45] Aug. 5, 1980

[54] METHOD FOR CAST-IN-PLACE CONCRETE WALLS

[75] Inventor: Kenneth K. Koch, Blue Springs, Mo.

[73] Assignee: International Housing Limited, Westport, Conn.

[21] Appl. No.: 970,000

[22] Filed: Dec. 15, 1978

[51] Int. Cl.[2] ..... E04B 1/41

[52] U.S. Cl. ..... 52/741; 52/361; 52/699

[58] Field of Search ..... 52/741, 743, 742, 745, 52/127, 351, 361, 364, 369, 235, 698, 699, 597, 712, 715

[56] References Cited

U.S. PATENT DOCUMENTS

| | | | |
|---|---|---|---|
| 4,056,904 | 11/1977 | Dawdy | 52/127 |
| 4,074,486 | 2/1978 | Grearson | 52/235 |

FOREIGN PATENT DOCUMENTS

| | | | |
|---|---|---|---|
| 237860 | 5/1964 | Austria | 52/361 |

*Primary Examiner*—J. Karl Bell

*Attorney, Agent, or Firm*—Blakely, Sokoloff, Taylor & Zafman

[57] ABSTRACT

A method for installing insulation on cast-in-place concrete walls. The method makes efficient use of expensive wall ties used during cast-in-place construction and provides for a quick, easy to learn, cost and labor saving method for insulating concrete walls. Furring strips are firmly and permanently affixed to cement walls by slotting the furring, placing them over the wall ties and driving a wedge-like member through the aperture of each wall tie which extends past the furring so that the furring is pressed tightly against the wall. Insulation panels are then affixed to the furring. The method may be easily adapted for insulating cast-in-place concrete ceilings.

9 Claims, 17 Drawing Figures

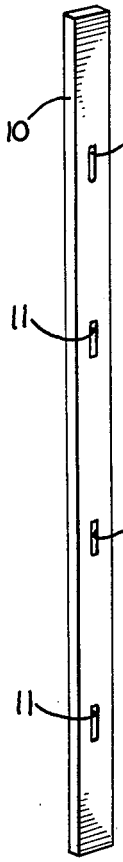
Fig. 5
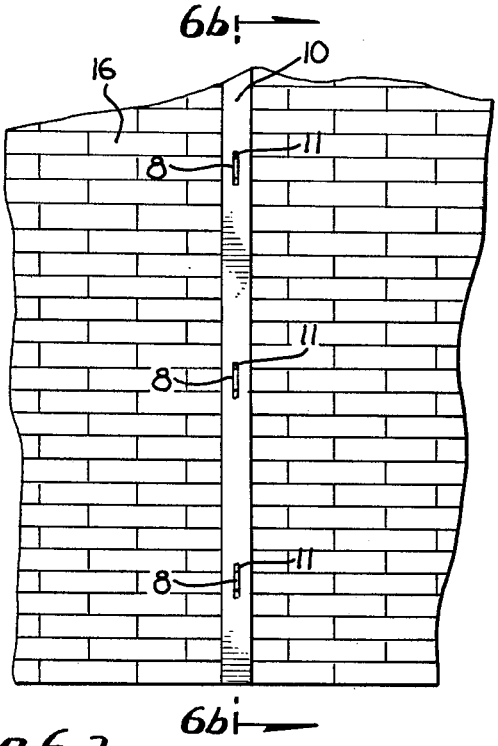
Fig. 6a
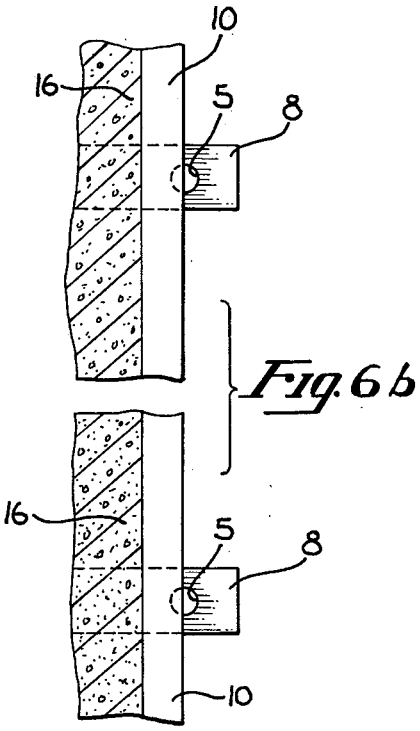
Fig. 6b
Fig. 7a
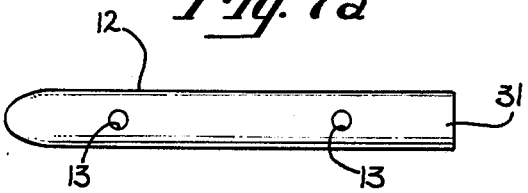
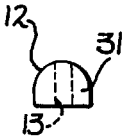
Fig. 7b
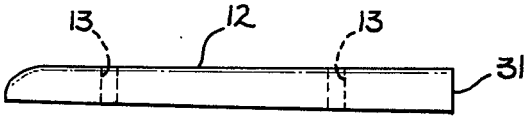
Fig. 7c

METHOD FOR CAST-IN-PLACE CONCRETE WALLS

BAGKGROUND OF THE INVENTION

1. Field of the Invention

The present invention relates to a method for applying insulation or other panels to a wall or ceiling.

2. Description of the Prior Art

The construction industry has been turning ever increasingly toward building structures with cast-in-place concrete. Using concrete building material is preferred because concrete masonry is the strongest, most durable building material known and is one of the least expensive materials for effectively combatting the adverse effects of weather, earthquake, fire and vermin.

The more successful methods for constructing buildings of concrete masonry are typified by the method disclosed by Robert Stout in his U.S. Pat. No. 3,728,838. By that method a monolithic, cast-in-place concrete building is formed in a series of steps. First, the site on which the building is to be constructed is prepared by levelling and compacting, and then placing a temporary interconnection of architectural forms to define the foundation form. The various service lines such as plumbing, electricity and gas are positioned within the foundation form, as well as are the requisite structural reinforcing bars. Moist concrete is then poured into the foundation form and allowed to cure. In like manner a group of architectural forms are temporarily secured together to define two spaced wall forms, including both interior and exterior walls, and including suitable openings for holding frames for windows and doors. The spaced wall forms rest on the slab of the foundation, and are held in spaced relationship by a plurality of wall tie members extending between said wall forms. The wall forms are constructed, and are interconnected, such that both sides of the resulting masonry walls are architecturally acceptable, without unsightly joint lines or concrete imperfections. As in the case of the foundation, the various service lines and reinforcing bars are positioned between the wall forms prior to the pouring of moist concrete. After the masonry walls have cured, the architectural walls forms are removed, and a temporary arrangement of shoring members is placed within the building structure. If desired, specially designed roof supporting brackets are secured to the wall ties on the exterior of the building for supporting overhanging portions of the roof form. The latter is constructed by temporarily interconnecting a series of architectural forms, and is supported by the shoring arrangement and the roof supporting brackets. Similar to the previous steps, moist concrete is poured in the roof form and allowed to cure, after which the roof form, temporary shoring arrangement, and the roof supporting brackets are removed. At this time, the masonry building is structurally complete. Various ancillary items such as the windows, doors, and service fixtures are then installed in the structure thereby completing the construction of the building.

Buildings of one, two or more stories have been constructed according to the method outlined above, with each succeeding ceiling being formed in a manner similar to forming the roof. Single family homes, industrial buildings, warehouses, and apartment buildings, as well as other similar enclosed structures have been built according to the above-described and similar methods. The method described above is particularly advantageous over conventional methods because fewer laborers are needed and the laborers that are employed may be unskilled workman. Furthermore, heavy, expensive machinery is not needed.

The method disclosed by Stout in U.S. Pat. No. 3,728,838 may use wall forms of the type described by that same inventor in U.S. Pat. No. 3,307,822. Thus, not only are the structures made according to the above-described method structurally sound, economical to manufacture and adaptable to mass production techniques by unskilled labor, they are also architecturally attractive. Both the interior and exterior surfaces of the walls can be formed with attractive designs on them. No further finishing of these walls is ordinarily required.

Quite often, climatic conditions or energy conservation considerations require that the exterior walls of a structure be insulated. Also, sometimes decorative paneling is desired to be mounted on the surface of the walls. For insulating concrete walls or for mounting decorative paneling on them, furring strips, which are typically 1 inch×4 inches×8 feet are first mounted on the concrete walls. After the furring strips are fixed to a concrete wall, insulation panels or other paneling are mounted on the furring. If insulation is first mounted on the furring, dry wall, other paneling or plaster may then be placed over the insulation.

Conventional methods for applying furring to concrete walls include nailing the furring strips to the wall with cement type nails or glueing them to the wall.

Because of the hardness of cement, nailing is obviously difficult. Besides requiring nails specially designed to penetrate the cement, stud drivers must be used. The builder must incur expenses for the cement type nails and the buying or renting of stud drivers, and in addition must face additional labor costs because of the time needed to nail the furring to the wall.

Glueing furring strips also requires additional time and consequently increased labor costs. The glue must first be applied to the surfaces of the wall and furring. Then the furring must be braced to the wall and time must pass while the glue sets. Besides the disadvantages caused by the delay and additional expense incurred in using this method, another drawback inherent with glueing is the deterioration over time of the bond between the surfaces of the furring and the wall. The last mentioned drawback can become critical when additional paneling, wall shelving or the like are in turn mounted over the insulation.

BRIEF SUMMARY OF THE INVENTION

The object of the present invention is to provide a quicker, more labor saving, more efficient method for installing insulation or other paneling over concrete walls than is conventionally practiced. It is another object of the present invention to diminish the time needed to mount furring strips upon concrete walls. It is a further object of this invention to reduce the costs in labor and equipment for mounting such furring upon concrete walls. It is a further object of the present invention to provide a stronger, more permanent attachment between the furring and the concrete wall so as to better withstand the deleterious effects of time and the tension caused by the weight of the insulation, other paneling, shelving or the like mounted on the furring.

These and other objects and advantages are achieved by the method of the present invention. The present invention utilizes the wall ties which extend between the wall forms used in making cast-in-place concrete buildings. The wall ties are used to maintain the interior and exterior wall forms in fixed spaced relation during pouring and curing of wet concrete. After the concrete has cured, the wall forms are removed while the ties remain in the wall. Then furring strips are slotted along their center lines at appropriate intervals and placed over the ties left in the wall. A fastening member is then inserted into the part of each wall tie's hole or slot (used to receive a pin during erection of the wall forms) which extends beyond the furring. The fastening member has an increasing cross-sectional area so that as the fastening member is inserted further into the wall tie's hole or slot, the furring material is pressed more and more firmly against the concrete surface. A nail is placed through a hole in the fastening member and driven into the furring to secure the fastening member in place. Insulation or other paneling or both are then mounted on the furring. By placing ties in the tie slots of wall forms used in the forming of roofs or intermediate floors, ceilings can be insulated or panelled in the same manner.

BRIEF DESCRIPTION OF THE DRAWINGS

FIG. 5 is a perspective view of the furring strip used in the method of the present invention.

FIG. 6A is an illustration of the furring strip of FIG. 5 placed against the wall of FIG. 2.

FIG. 6B is a sectional view taken along line 6B—6B of FIG. 6A showing the wall ties extending through the furring.

FIGS. 7A–7C show side, back and top views respectively of the fastening member used in the method of the present invention.

DETAILED DESCRIPTION OF THE INVENTION

Figure 1:
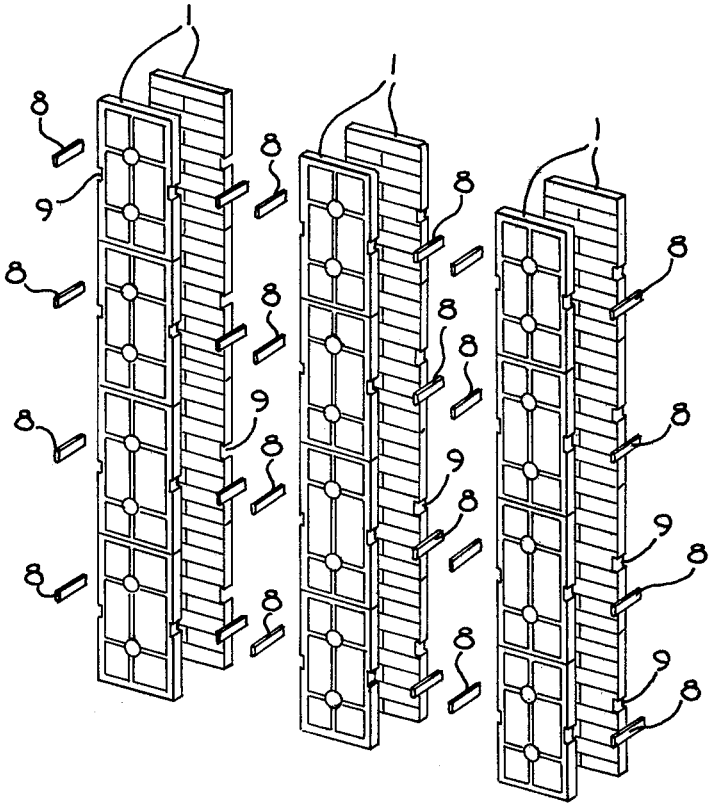
FIG. 1 is an exploded perspective view of a portion of the wall forms and wall ties which are temporarily secured together to receive uncured cement in the method used to construct cast-in-place buildings.

In the following description the method of the present invention will be described in connection with the mounting of insulation to concrete walls. However, it will be obvious to one skilled in the art that the method of this invention could be used as well in connection with the mounting of other types of paneling, such as decorative paneling, as well as wall shelving and the like. In referring to the drawings, the same identification numerals will be used throughout to denote identical parts and structures.

In FIG. 1 an exploded view is shown of the wall forms used in a popular method of cast-in-place concrete construction. These forms are secured together to define the walls of a structure and remain in place to receive wet concrete and hold it in place while the concrete cures. The wall forms which define each side of the wall are secured together by nuts and bolts or pins and wedges (not shown). The wall forms which define opposite sides of the wall are held in spaced relation by wall ties 8, each of which is inserted into the tie slots 9 of corresponding wall forms.

After the concrete has cured, wall forms 1 are removed to expose a finished concrete wall 16. Wall ties 8, which were bonded to the cement during curing, remain in the wall. The part of each wall tie which extends out from the exterior face of the concrete wall is normally broken off with the remaining part covered with mortar to maintain the aesthetic quality of the exterior surface. The part of each wall tie which extends from the interior surface of the concrete wall is left intact for purposes which will become apparent from the discussion which follows.

Figure 3:
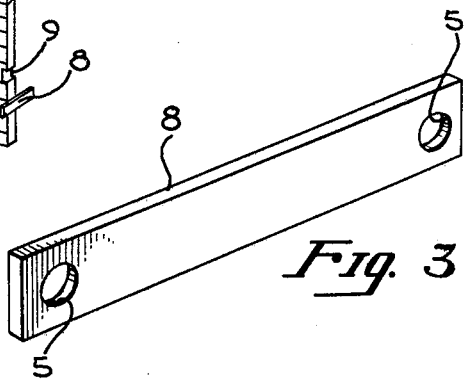
FIG. 3 is a perspective view of one embodiment of the wall tie used in the method illustrated in FIG. 1.
Figure 2:
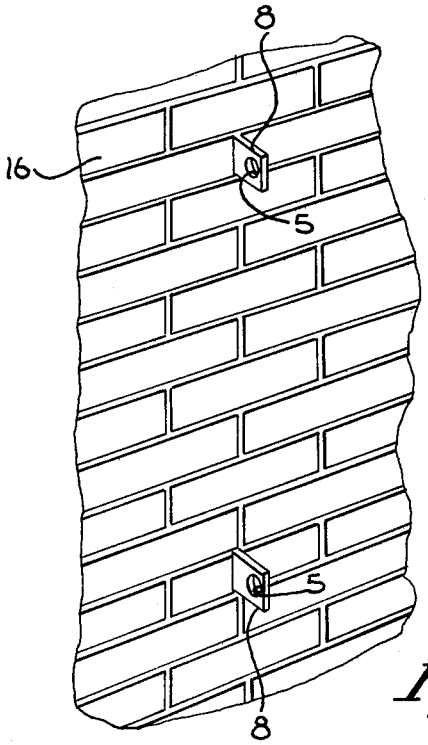
FIG. 2 is a perspective view of a portion of a cement wall formed according to the method illustrated in FIG. 1, with the wall forms removed and the wall ties left in the wall.
Figure 4:
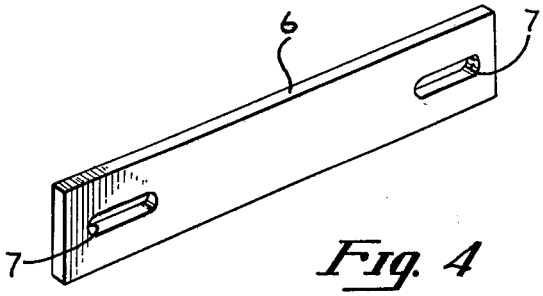
FIG. 4 is a perspective view of another embodiment of the wall tie used in the method illustrated in FIG. 1.

Wall tie 8 is shown in detail in FIG. 3. It is a rectangular solid and may be made from almost any strong, rigid material. Steel or aluminum may be used as well as other metals, alloys or hard plastics. Wall tie 8 has a hole 5 through each of its ends. FIG. 4 illustrates another embodiment of the wall tie used in cast-in-place construction. This embodiment is designated by the numeral 6 and is referred to as the slotted wall tie. Each embodiment of the wall tie may be interchanged with the other for maintaining the wall forms in spaced relation and for functioning in the method of the present invention. For the purpose of convenience, the method of the invention will be described as it is practiced with wall tie 8 of FIG. 3.

Figure 14:
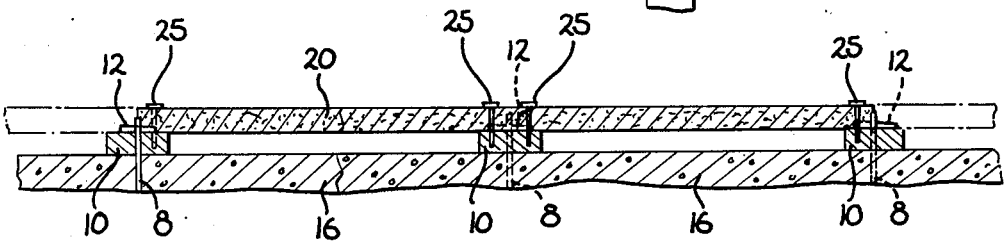
FIG. 14 is a sectional view of the panel of insulation mounted on furring strips of FIG. 12 taken along line 14—14.

After wall forms 1 have been removed with wall ties 8 remaining in the wall, furring strips are affixed to the cement wall. Insulation is then mounted on the furring. This method provides for a dead air space between the insulation and the concrete wall which aids in insulating the wall and provides for a chamber to install conduit for electrical wiring or the like. FIG. 14 illustrates the spacial relationship of the furring strips 10 to the insulation 20 and the cement wall 16 and the dead air space 29 created therebetween.

In FIG. 5 furring strip 10 is illustrated in perspective. It is typically a 1 inch×4 inch strip of construction grade lumber which is as long as the wall is high. Other dimensions and materials for the furring may be used, however, as conditions permit. The furring strip is slotted along its center line at intervals which correspond to the vertical distances between wall ties 8. It is noted here that wall ties 8 align vertically in almost a perfect plumb line because of the restraints inherent in the method of securing wall forms 1 together during cast-in-place construction. The slots in furring strip 10 are identified by numeral 11 in FIG. 5.

Furring strip 10 is then placed over wall ties 8 and pressed up against wall 16 as shown in FIG. 6A. As can be seen in FIG. 6B, each wall tie 8 extends beyond furring strip 10 to expose part of hole 5.

According to the method of this invention, furring strip 10 is pressed up tightly against and permanently anchored to cement wall 16 by inserting a wedge-like fastening member into hole 5 in front of furring strip 10. The preferred embodiment of the fastening member is illustrated in FIGS. 7A–7C and is identified by numeral 12. Fastening member 12 is also referred to as the "quick wedge." Quick wedge 12 is about three (3) inches long and is manufactured from strong rigid material. Metals, such as steel, aluminum or ferrous-metal alloys, or high impact nylon or nylon-fiberglass may be used. Its bottom surface 19 is flat and is intended to be placed against furring strip 10. Except for its leading edge, which is tapered, bottom surface 11 has a substantially constant width which is smaller than the diameter of hole 5. Quick wedge 12 has a substantially curved cross section when viewed from its back. Its height increases gradually from the leading edge. Back surface 31 is substantially flat, being intended to be struck by a hammer or mallet during insertion into hole 5. Quick wedge 12 has hole or holes 13 disposed vertically through it and positioned about one-quarter of the quick wedge's length from its ends.

Figure 8:
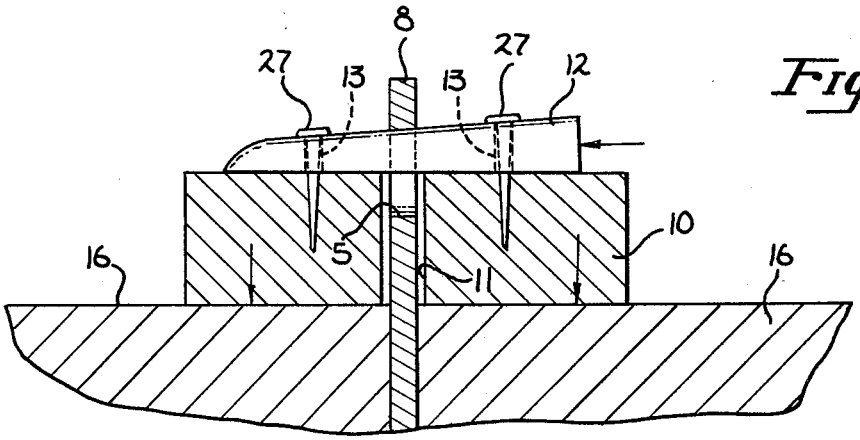
FIG. 8 is a plan view of the fastening member of FIGS. 7A–7C being inserted through the wall tie, in front of the furring strip mounted on the cement wall as shown in FIGS. 6A and 6B.

As shown in FIG. 8, quick wedge 12 is driven into the exposed part of hole 5, and thereby furring strip 10 is pushed away from the frontmost boundary of hole 5 and is pressed more and more tightly against cement wall 16.

Figure 9:
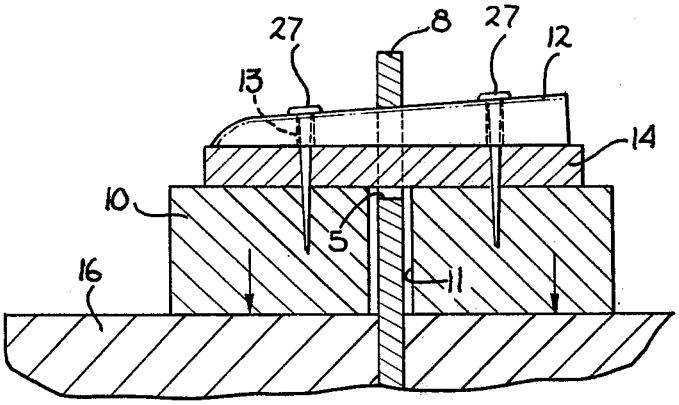
FIG. 9 is a plan view of the fastening member of FIGS. 7A–7C being inserted into the wall tie in front a spacer placed over the furring strip mounted on the cement wall as shown in FIGS. 6A and 6B.

Quick wedge 12 is made in different dimensions, usually varying in height, to accommodate the variations which exist in the entent to which holes 5 extend past furring strip 10. For those instances in which hole 5 completely extends beyond furring strip 10, for example, as shown in FIG. 9, a small, thin, slotted piece of wood 14 or other material may be placed over wall tie 8 to cover part of hole 5 and to act as a spacer. Quick wedge 12 is then driven into the exposed portion of hole 5 as described above.

Figure 10:
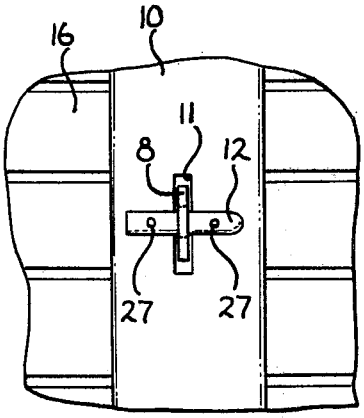
FIG. 10 is an expanded perspective view of the fastening member, wall tie and furring.
Figure 11:
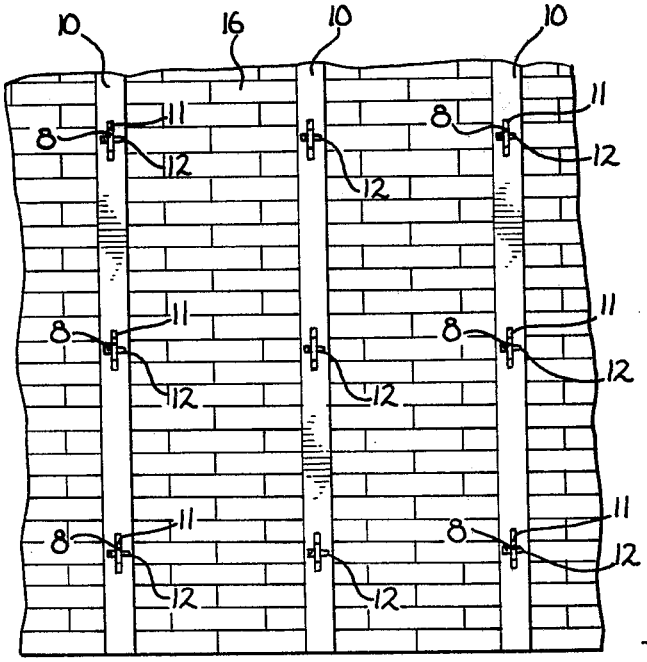
FIG. 11 is a front view of a portion of the furring strips affixed to a cement wall according to the method of the present invention.

After quick wedge 12 has been driven into hole 5 so that furring strip 10 is pressed firmly and tightly against cement wall 16, nail or nails 27 are placed through holes 13 of the quick wedge and driven into the furring. Thus, the quick wedge is secured in place and the furring is permanently wedged in place against and anchored to the cement wall. (See FIG. 10.) FIG. 11 illustrates a portion of cement wall 16 with furring strips 10 permanently in place.

Figure 12:
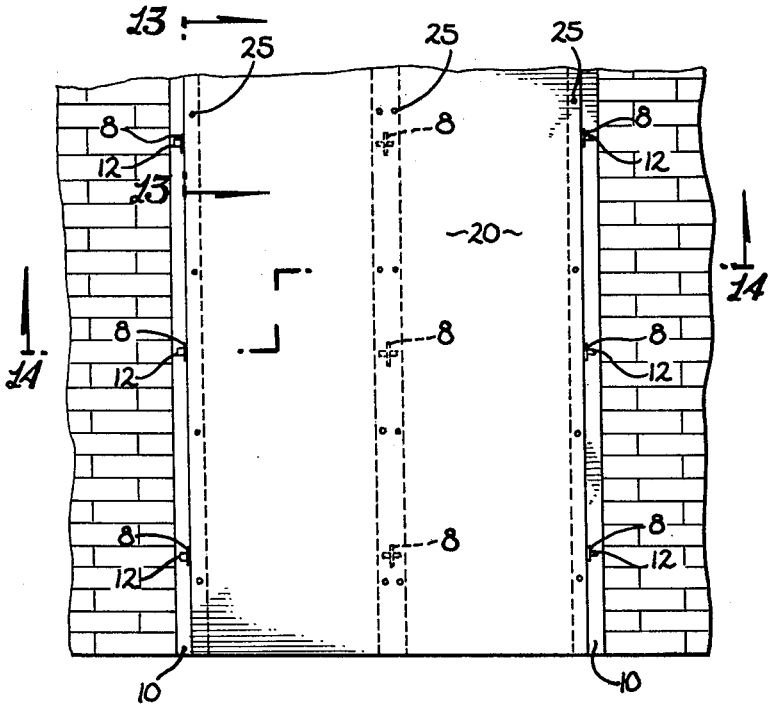
FIG. 12 is a front view of a panel of insulation mounted on furring strips according to the mentod of the present invention.
Figure 13:
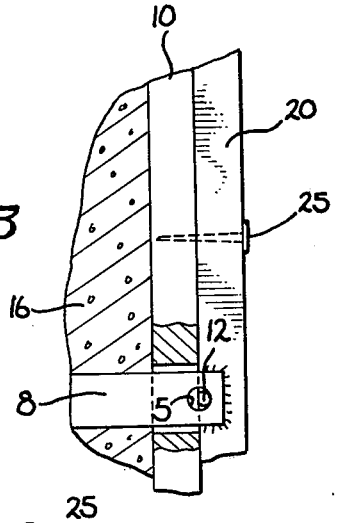
FIG. 13 is a sectional view of the panel of insulation mounted on furring strips of FIG. 12 taken along line 13—13.

Insulation in the form of panels 20 is then mounted on the furring. (See FIG. 12) The insulation could be made from one of many known insulating materials, for example, rigid polystyrene plastic or urethane. The panels are cut so that they are wide enough to extend from the wall ties extending through one furring strip to the wall ties extending through the second furring strip over. The insulation is installed by placing one edge of panel 20 against the wall ties extending through one furring strip, placing its other edge against the wall ties extending through the second furring strip over and pushing in the center of the panel so that the wall ties of the center furring strip (shown in phantom lines in FIG. 12) partially penetrate the insulation. The insulation panel is then permanently affixed to the furring by driving nails 25 through the insulation into the center and two side furring strips. (see FIGS. 12 and 13.)

If more rigid insulation panels are used, or if narrower panels are used, the insulation may be mounted on two consecutive furring strips without an intervening center furring strip. In that event, of course, the insulation would be nailed to the furring strips at its sides.

FIG. 14 provides a top view of insulation 20 mounted on cement wall 16 according to the method of the present invention. Dead air space 29 is thereby formed. This dead air space, as previously discussed aids in insulating the wall and provides a chamber through which electrical conduit and the like could be placed prior to the mounting of the insulation panels. Other types of paneling, such as decorative paneling could be installed by the method of this invention. By the same method, wall shelving could be installed on cement walls. Without departing from the spirit of the present invention, decorative paneling and wall shelving could be installed over the previously mounted insulation panels. The present method provides for strong and permanent installation of paneling or shelving onto cement walls. This invention provides a quick, labor and cost saving method for making such installations and is simple enough for even the novice home builder to use competently.

Insulation of ceilings is also accomplished by the present invention. Short tie sections (not shown), similar to wall ties 12, are inserted into the tie slots of the forms used in ceiling or intermediate floor slab construction before the concrete is poured. After the concrete has cured and the forms are removed, the short tie sections which extend from the ceiling are used in the same manner as wall ties 12 for the fastening of furring strips 10 to the ceiling, with the remaining steps for insulating the ceiling being substantially the same as that described for insulating walls.

While the invention has been illustrated and described in connection with the preferred procedures, it should be understood that it is capable of variation without departing from the principals of the invention and it is intended that any modified procedures or equivalents which may be reasonably included within their scope are covered by the claims.

What is claimed is:

1. A method for insulating a cast-in-place concrete wall in which wall ties are used for maintaining oppositely disposed wall forms in spaced relation during curing of said concrete wall, comprising:

a. retaining said wall ties in said wall after said wall forms have been removed;

b. cutting slots at intervals equal to the vertical distances between said wall ties out of furring strips along the center lines of said furring strips;

c. placing each of said furring strips against said cement wall with said wall ties extending through said slots of said furring strip;

d. driving a fastening member into the exposed part of the aperture of each of said wall ties which extends beyond said furring strip so that said furring strip is pressed tightly against and anchored to said cement wall;

e. affixing said fastening member which has been driven into said aperture of said wall tie to said furring strip;

f. placing insulation panels over said furring strips; and g. affixing said insulation panels to said furring strips.

2. A method for insulating cast-in-place concrete walls as in claim 1 wherein the step of affixing said insulation panels to said furring strips comprises driving a first set of nails through said insulation panels and into said furring strips.

3. A method for insulating cast-in-place concrete walls as in claim 1 wherein said fastening member is a substantially wedge shaped member of rigid material, said member having a flat bottom surface, a tapered leading edge, a flat back surface, a substantially arcuate transverse cross section, and having a height which gradually increases from said leading edge to said back surface, and further having at least one hole through said member disposed along the center line of and perpendicular to said bottom surface.

4. A method for insulating cast-in-place concrete walls as in claim 3 wherein said rigid material is metal.

5. A method for insulating cast-in-place concrete walls as in claim 3 wherein said rigid material is high impact nylon-fiberglass.

6. A method for insulating cast-in-place concrete walls as in claim 3 wherein the step of affixing said fastening member to said furring strip comprises driving one of a second set of nails through said hole through said fastening member and into said furring strip.

7. A method for insulating a cast-in-place concrete ceiling comprising:

a. placing short tie sections into the tie slots of forms used in ceiling construction before said concrete is poured;

b. retaining said short tie sections after said concrete ceiling has cured and said forms are removed;

c. cutting slots at intervals equal to the distances between said short tie sections out of said furring strips along the center lines of said furring strips;

d. placing each of said furring strips against said cement wall with said short tie sections extending through said slots of said furring strip;

e. driving said fastening member into the exposed part of the aperture of each of said short tie sections which extends beyond said furring strip so that said furring strip is pressed tightly against and anchored to said cement ceiling;

f. affixing said fastening member which has been driven into the aperture of said short tie section to said furring strip;

g. placing insulation panels over said furring strips; and h. affixing said insulation panels to said furring strips.

8. A method for mounting furring strips to a cast-in-place concrete wall in which wall ties are used for maintaining oppositely disposed wall forms in spaced relation during curing of said concrete wall, comprising:

a. retaining said wall ties in said wall after said wall forms have been removed;

b. cutting slots at intervals equal to the vertical distances between said wall ties out of said furring strips along the center lines of said furring strips;

c. placing each of said furring strips against said cement wall with said wall ties extending through said slots of said furring strip;

d. driving a fastening member into the exposed part of the aperture of each of said wall ties which extends beyond said furring strip so that said furring strip is pressed tightly against and anchored to said cement wall; and e. affixing said fastening member which has been driven into said aperture of said wall tie to said furring strip.

9. A method for mounting furring strips to cast-in-place concrete walls as in claim 8 wherein said fastening member is a substantially wedge shaped member of rigid material, said member having a flat bottom surface, a tapered leading edge, a flat back surface, a substantially arcuate transverse cross section, and having a height which gradually increases from said leading edge to said back surface, and further having at least one hole through said member disposed along the center line of and perpendicular to said bottom surface, and wherein the step of affixing said fastening member to said furring strip comprises driving one of said second set of nails through said hole through said fastening member and into said furring strip.

* * * * *